United States Patent [19]

Skach, Jr. et al.

[11] 4,331,711

[45] May 25, 1982

[54] PRODUCTION OF SALT-COATED MAGNESIUM PARTICLES

[75] Inventors: Edward J. Skach, Jr., Freeport; Marshall P. Neipert, Lake Jackson, both of Tex.

[73] Assignee: The Dow Chemical Company, Midland, Mich.

[21] Appl. No.: 936,978

[22] Filed: Aug. 25, 1978

[51] Int. Cl.[3] ..... B05D 1/12

[52] U.S. Cl. ..... 427/180; 75/58; 75/251; 75/0.5 B; 428/403

[58] Field of Search ..... 75/0.5 B, 0.5 C, 254, 75/251, 58; 427/11, 180, 216; 264/7; 428/580, 403

[56] References Cited

U.S. PATENT DOCUMENTS

| | | | |
|---|---|---|---|
| 3,252,809 | 5/1966 | Simers | 428/403 |
| 3,314,782 | 4/1967 | Arnaud | 75/58 |
| 3,440,181 | 4/1969 | Olstowski | 428/403 |
| 3,881,913 | 5/1975 | Barannik | 75/0.5 L |
| 3,957,502 | 5/1976 | Cull | 75/58 |
| 4,024,295 | 5/1977 | Chase | 427/216 |
| 4,040,818 | 8/1977 | Clegg | 75/58 |

FOREIGN PATENT DOCUMENTS

| | | | |
|---|---|---|---|
| 2010841 | 9/1971 | Fed. Rep. of Germany | 75/0.5 B |
| 2355205 | 5/1975 | Fed. Rep. of Germany | 75/0.5 B |
| 2541235 | 3/1977 | Fed. Rep. of Germany | 427/11 |
| 263401 | 1/1971 | U.S.S.R. | 264/7 |

*Primary Examiner*—Sam Silverberg
*Attorney, Agent, or Firm*—W. J. Lee

[57] ABSTRACT

Salt-coated magnesium particles, useful as desulfurizing agents in steel making, are prepared by impacting onto magnesium particles a very fine salt powder, such as in a ball-mill, then screening to obtain 10–65 mesh size particles containing about 80% to about 95% Mg by weight.

11 Claims, No Drawings

PRODUCTION OF SALT-COATED MAGNESIUM PARTICLES

BACKGROUND OF THE INVENTION

It is well known in the steel and iron industry that desulfurization or deoxidation of molten steel or iron may be accomplished by the addition of magnesium thereto. Various methods have been employed for introducing the magnesium into the molten iron or steel, e.g., adding Mg-containing pellets, powders, wires, rods, briquettes, etc. to the melt.

The present invention pertains to salt-coated magnesium particles for use in treating molten iron or steel and to a method for preparing the salt-coated magnesium particles.

It is well known that finely divided magnesium is easily oxidized and is subject to rapid combustion unless provided with a protective coating to guard against rapid oxidation.

It is believed that U.S. Pat. No. 3,881,913 and U.S. Pat. No. 3,969,104 (a divisional of U.S. Pat. No. 3,881,913) are illustrative of the most relevant prior art pertaining to the present invention. The patents teach the preparation of a magnesium-salt pellet by forming droplets of molten Mg in the presence of molten salt, then cooling the so-formed salt-coated Mg pellets. The patents also disclose that the Mg-salt pellets are useful for inoculating molten ferrous metals, e.g., for desulfurizing steel. U.S. Pat. No. 2,304,130; U.S. Pat. No. 2,699,576; U.S. Pat. No. 3,520,718; U.S. Pat. No. 2,676,359; and U.S. Pat. No. 2,934,789 are disclosed in U.S. Pat. No. 3,881,913 as being relevant art.

The present invention provides an alternate, improved method for producing salt-coated Mg pellets or granules and does not require that the salt or the Mg be molten during the salt-coating process. Furthermore, the present process provides a more uniform particle size and more consistent Mg/salt ratios than is provided by the use of the prior method of coating molten Mg beads with molten salt in a molten Mg bead generator.

It has long been known in the steel and iron industry that solid Mg cell sludge (which contains Mg, cell bath materials (salt), MgO and impurities) is marginally operable as an inoculant in ferrous melts when injected beneath the surface of the melt. Attempts have been made for many years to grind or pulverize the sludge to free the small beads of Mg which are dispersed in the sludge and then separate the beads from the friable, more powdery salts, leaving only a thin coating of the salts and impurities on the Mg beads. Such Mg beads, then, would ordinarily contain from about 40 to about 90% Mg.

The efficacy of such Mg beads retrieved from cell sludge as an inoculant for ferrous melts has been limited by the inconsistencies of the grinding and separation techniques and by the inconsistencies of the salt-coated Mg beads obtained therefrom. The steel and iron industries require relatively consistent batches of inoculants in order to avoid under-charging or over-charging the ferrous melts without having to adjust the injected amount according to varying pellet sizes and Mg concentrations.

SUMMARY OF THE INVENTION

Small particles of Mg metal and a powdery salt are mixed in a ball mill under an inert atmosphere or dry air thereby forming non-pyrophoric, salt-encrusted Mg particles which are particularly useful for inoculating ferrous melts.

DETAILED DESCRIPTION OF THE INVENTION

The Mg metal particles for use in the present invention may be obtained from various sources and may contain as alloyed ingredients, other metals, such as Al, Cu, Zn, Si, Zr, Th, Mn and metals of the rare earth series. Mg particles obtained from grinding or milling operations may be employed, so long as they fall within the desired particle size range. Preferably, the Mg particles are obtained by methods which create small spherical particles, such as by spraying molten Mg as droplets into an inert atmosphere where they solidify, or by dropping molten Mg onto a spinning disc (as in U.S. Pat. No. 2,699,576 and U.S. Pat. No. 3,520,718) where the Mg is spun off as droplets into an inert atmosphere where they solidify. Mg alloys suitable for use in the present invention should be soft (malleable) enough that salt powder may be impacted onto the surface thereof and substantially adhere to said surface.

One of the advantages of employing Mg particles which are already formed prior to the salt-coating process, is that the particles may be prescreened so as to salt-coat only those particles which are within the desired range and the remaining particles may be recycled to the Mg melt or used in some other manner without having been salt-coated. This feature substantially permits the avoidance of undesired sizes of salt-coated Mg particles, thereby substantially reducing or avoiding wasted material and expense. Thus, the present invention provides a method for preparing only the desired sizes of salt-coated Mg particles, yet the excess powdery salt may be re-cycled back to the salt-coating process.

The salt which may be employed in the present invention may be a single compound, such as a halide of Na, K, Li, Mg, Ca, Ba, Mn or Sr or may be a mixture of two or more of these salts. It is possible, and in some cases desirable, to employ mixtures of salts wherein the halide of one or more of the salts is a different halide than of the other salts. For instance, mixtures of $MgCl_2$, NaCl, LiCl, and $CaF_2$ may be employed in various proportions. For example, U.S. Pat. No. 2,888,389; U.S. Pat. No. 2,950,236; and U.S. Pat. No. 3,565,917 are patents which teach salt mixtures for Mg production. Mixtures of salts are taught in U.S. Pat. No. 3,881,913 which are recognizable as mixtures such as are known to be employed in electrolytic Mg production as "cell bath" electrolyte compositions. Such cell bath compositions are also known to be present in Mg cell sludge and when the cell sludge is ground up to free the small beads of Mg metal trapped therein, some of the salt mixture is found to be present on the Mg beads as a coating. Such beads, after screening and classifying to obtain the desired particle sizes, are suitable for inoculating ferrous melts. If there is an inadequate supply of such beads, the present invention provides a method for substantially duplicating the composition of the known beads if the inoculators of ferrous melts do not wish to adjust the inoculating procedure to a different composition. As used herein, the term "salt" comprises ingredients which are predominantly halide salts, but may also contain up to about 25% of oxides or other salts.

On the other hand, for those inoculators who do not desire to use Mg beads coated with more than one salt, the present invention can supply Mg beads coated with only one salt.

Thus, the present invention provides a method for salt-coating Mg particles having either a wide range of particle sizes or a given narrow range of particle sizes, with the salt coating being a single salt or a mixture of two or more salts.

The Mg particles of interest in the present invention may be called "powders", "beads", "granules", "pellets" or other such term. Generally, the preferred particles will be substantially spherical or oval in shape and will have a particle size in the range of about 8 mesh to about 100 mesh (U.S. standard sieve size). For the common practice of inoculating ferous melts through a lance, the preferred particle size range is usually about 10 to about 65 mesh.

The ball mill employed in the present invention may be any of the well-known mills which are composed principally of a revolving compartment, which revolves around a substantially horizontally-disposed axis, said compartment containing a plurality of free-moving balls (generally made of solid metal, steel, alumina, or zirconia) which tumble and roll around within the revolving compartment. Such mills are attached to a source of power which causes the revolving compartment to rotate at a speed which causes the balls to move with the rotating compartment wall until the balls fall back down because of gravity. The balls do not follow the rotating wall completely around the circuit. Steel or ceramic balls, rods, or cylinders having a weight in the range of about 15 to about 100 gms, and a diameter in the range of about 0.6 to about 3.0 cm are generally preferred.

Other equipment containing impact means which may be employed in place of a ball-mill include such things as tumbling mills, rod mills, gyratory grinders, roller mills, and ring roll mills. Such mills may be employed to impact the salt particles onto the Mg metal particles without flattening or rupturing a substantial amount of the Mg particles.

The purpose of the ball mill or other such device is to gently pound, impact, or impress the fine salt onto the surface of the malleable magnesium particles without substantially flattening, deforming, or rupturing the magnesium particles. Fine salt impacted onto the surface of the Mg particles tends to remain adhered thereto during normal handling or storing.

There is an interdependent relationship between the ratio of salt powder/Mg particles, the extent of impaction by the impact means in the mill and the particle size of the magnesium particles. An overabundance of salt powder in the mill during impaction can "cushion" the Mg particles and reduce the extent of impact of the salt onto the Mg particles, while an insufficient amount of salt powder can permit needless pounding of the Mg particles by the impact means while impacting insufficient amounts of salt onto the Mg particles. Mg particles which are relatively large may suffer more distortion during the impaction than a relatively small particle, because of the softness or malleability of the Mg. The extent of impaction on the Mg particles by the impact means is related to the weight and size of the impact means as well as to the cushioning effect of surplus salt powder.

It is preferred then, that the ratio of salt powder/Mg particles fed to the impact mill be in the range of about 30/70 to about 70/30 by weight, preferably in the range of about 40/60 to about 60/40, especially when the Mg particles are in the range of about 10 to 65 mesh (U.S. standard sieve size) and that the impact means used in the impact mill be made of ceramic material. A dry or inert atmosphere may be provided in the process by employing, e.g., nitrogen, argon, helium, $CO_2$, methane, or relatively dry air. Depending on the ambient temperature, "relatively dry air" should have a maximum relative humidity of 35%, preferably 20%.

As used herein, mesh size refers to standard U.S. Sieve Sizes, percents refer to weight percents, and ratios refer to weight ratios. A mesh size range of, say, 8 mesh to 100 mesh means the particles fall through an 8 mesh screen and are retained on a 100 mesh screen; a mesh size of −100 mesh means the particles pass through a 100 mesh screen.

EXAMPLE

Into a laboratory size ball mill, having a cylindrical revolving chamber of about 8800 ml. capacity and containing a plurality of ceramic cylinders, each weighing about 25 gms. and having a diameter of about 2.1 cm. there is placed (under a substantially dry atmosphere) about 226 gms. of 30×50 mesh Mg beads and about 226.8 gms. of −100 mesh salt. The salt comprises a mixture of about 12% $MgCl_2$, about 52% NaCl, about 12% $CaCl_2$, about 17% KCl, about 6% MgO, and about 1.0% $CaF_2$, said mixture being known to be useful as an electrolytic cell bath material. The mixture is ball-milled for about 45 minutes at a rotational speed of about 50 rpm.

The resulting salt-encrusted Mg particles, after screening on a 50 mesh screen to remove loose salt powder contains about 85% Mg. Thus about 18% of the salt charged into the ball-mill is retained on the Mg particles. The so-coated free-flowing particles are non-pyrophoric and are operable as an inoculant material for injection through a lance beneath the surface of a molten ferrous metal.

We claim:

1. A method for producing non-pyrophoric salt-encrusted magnesium particles, said method comprising providing particles of Mg metal or Mg alloy in an impact mill, protecting said particles from substantial contact with moisture by use of an inert atmosphere or substantially dry air, said impact mill being a ball mill which is a compartment revolvable around a substantially horizontally-disposed axis and which contains, as impact means, a plurality of free-moving metal or ceramic balls rods, or cylinders, also providing in the impact mill a powdery salt of −100 mesh particle size in an amount at least sufficient to completely coat the Mg or Mg alloy particles, rotating the compartment at a speed which causes the impact means to move with the rotating compartment until the impact means fall back down because of gravity, rotating for a time sufficient to substantially completely impact the Mg or Mg alloy particles with a coating of salt, and removing the so-formed salt-encrusted Mg or Mg alloy particles from the impact mill.

2. The process of claim 1 wherein the Mg particles are in the particle size range of about 8 mesh to about 100 mesh, and wherein the powdery salt is of a particle size substantially smaller than 100 mesh.

3. The process of claim 1 wherein the Mg particles are in the particle size range of about 20 mesh to about 50 mesh, and wherein the powdery salt is of a particle size of −100 mesh.

4. The process of claim 1 wherein the powdery salt is a mixture comprised predominantly of two or more salts selected from the group consisting of halides of Na, K, Li, Mg, Ca, Ba, Mn and Sr.

5. The process of claim 1 wherein the inert atmosphere is at least one gas selected from the group consisting of nitrogen, argon, helium, $Co_2$ methane and relatively dry air.

6. The process of claim 1 wherein the impact means comprises metal or ceramic balls, rods, or cylinders, each having a weight in the range of about 15 to about 100 gms., and a diameter in the range of about 0.6 to about 3.0 cm.

7. The process of claim 1 wherein the ratio of powdery salt/Mg particles charged to the impact mill is in the range of about 30/70 to about 70/30 by weight.

8. The process of claim 1 wherein the Mg particles are in the particle size range of about 10 mesh to about 65 mesh.

9. The process of claim 1 wherein the Mg particles comprise Mg alloyed with at least one metal selected from the group consisting of Al, Cu, Zn, Si, Zr, Th, Mn and metals of the rare earth series of the Periodic Table.

10. The process of claim 1 wherein the ratio of powdery salt/Mg particles charged to the impact mill is in the range of about 60/40 to about 40/60 by weight.

11. A method for impacting a protective salt coating onto Mg particles, said method comprising providing a ball mill, equipped with metal or ceramic balls, rods, or cylinders, each having a weight in the range of about 15 to about 100 gms and a diameter in the range of about 0.6 to about 3.0 cm, providing in said ball mill particles of Mg metal or Mg alloy in the particle size range of about 8 mesh to about 100 mesh, also providing in said ball mill a powdery salt of a particle size of −100 mesh; the amount of powdery salt being sufficient to provide a ratio of salt/Mg of Mg alloy particles in the range of about 30/70 to about 70/30 by weight, tumbling the mixture of Mg or Mg alloy particles and salt in the ball mill for a time sufficient to substantially completely impact the Mg or Mg alloy particles with a coating of salt, removing the mixture from the ball mill, and substantially separating salt-encrusted metal particles from any free salt remaining.

* * * * *

UNITED STATES PATENT AND TRADEMARK OFFICE

CERTIFICATE OF CORRECTION

PATENT NO. : 4,331,711

DATED : May 25, 1982

INVENTOR(S) : Edward J. Skach, Jr., and Marshall P. Neipert

It is certified that error appears in the above—identified patent and that said Letters Patent is hereby corrected as shown below:

Col. 5, line 10, Claim 5, please add a comma(,) between the word $CO_2$ and methane.

Col. 6, line 17, correct the word "of" between salt/Mg and Mg to --or--.

Signed and Sealed this

*Twenty-first* Day of *September 1982*

[SEAL]

*Attest:*

GERALD J. MOSSINGHOFF

*Attesting Officer*

*Commissioner of Patents and Trademarks*